United States Patent [19]

Warren

[11] 4,279,327

[45] Jul. 21, 1981

[54] VENTILATING LADDER

[76] Inventor: Richard A. Warren, 1223 Hamilton, Elmhurst, Ill. 60126

[21] Appl. No.: 115,040

[22] Filed: Apr. 4, 1980

[51] Int. Cl.[3] ..... E06C 1/36

[52] U.S. Cl. ..... 182/206; 182/45; 182/152

[58] Field of Search ..... 182/206, 214, 107, 108, 182/45, 152; 248/210, 211

[56] References Cited

U.S. PATENT DOCUMENTS

| | | | |
|---|---|---|---|
| 1,018,877 | 2/1912 | Chickering | 182/206 |
| 1,030,905 | 7/1912 | Lucas | 182/206 |
| 1,393,048 | 10/1921 | Stiles | 182/206 |
| 2,341,510 | 2/1944 | Born | 182/206 |
| 2,432,781 | 12/1947 | Mann | 182/206 |
| 2,439,430 | 4/1948 | Hurd | 182/206 |
| 2,448,716 | 9/1948 | Hurd | 182/206 |
| 2,556,998 | 6/1951 | Frazier | 182/206 |

*Primary Examiner*—Reinaldo P. Machado
*Attorney, Agent, or Firm*—David C. White

[57] ABSTRACT

This invention relates to a device for attachment to ladders which will enable them to securely anchor to the peak of a roof quickly and easily, while increasing safety for firemen cutting ventilation holes near the peak of the roof. The attachment for roof ladders allows the firemen to stand on a support directly below the roof area where the hole is cut. The invention can be folded into a compact bundle for storage and transportation, and is light in weight.

4 Claims, 2 Drawing Figures

VENTILATING LADDER

BACKGROUND OF THE INVENTION

This invention relates to a device for attachment to ladders which will enable them to securely anchor to the peak of a roof quickly and easily, while increasing safety for firemen cutting ventilation holes near the peak of the roof.

In the prior art, roof ladders of the conventional type with ladder rungs every foot apart and ladder hooks near the top of the ladders are used. The firemen climb the conventional ladder to a place near the peak of the roof and then reach over the side of the ladder to cut a hole in the roof with a power saw.

SUMMARY OF THE INVENTION

The principal feature of the invention consists of a pair of long side bars separated by a distance grater than the distance across the area where a ventilation hole is to be cut into the roof. Each long side bar is integrally secured to a rigid bar hook which is hooked over the roof ridge to securely engage the long side bar to the roof peak. A long lower bar member is attached to the top portions of a conventional roof ladder by means of a pair of transverse short bars fitting tightly against the top portion of the roof ladder, and integrally secured to the long lower bar member. A pair of sleeve portions are integrally secured to the top of the roof ladder through which the pair of transverse short bars slide, and each transverse short bar is secured to the roof ladder and sleeve by means of a pin.

It is therefore the principal object of this invention to provide a roof ladder attachment that can be secured to the peak ridge of a roof while one is standing on a roof ladder or similarsupport directly below the open area between the long side bars and the long lower bar member of the ladder attachment.

Another object of the invention is to provide a means of cutting a hole large enough to be of practical use near the top of a roof ladder while standing directly below the area through which the hole is cut.

Another object of the invention is to provide a roof ladder attachment that is light in weight and will not increase the weight when compared to conventional roof ladders used for the same purpose without the invention attached.

Another object of the invention is to provide a roof ladder attachment that can be folded into a compact bundle for storage or transportation in a minimum of time.

Another object of the invention is to increase the safety factor for the firemen when cutting a hole in a roof.

DESCRIPTION OF THE PREFERRED EMBODIMENT

Figure 1:
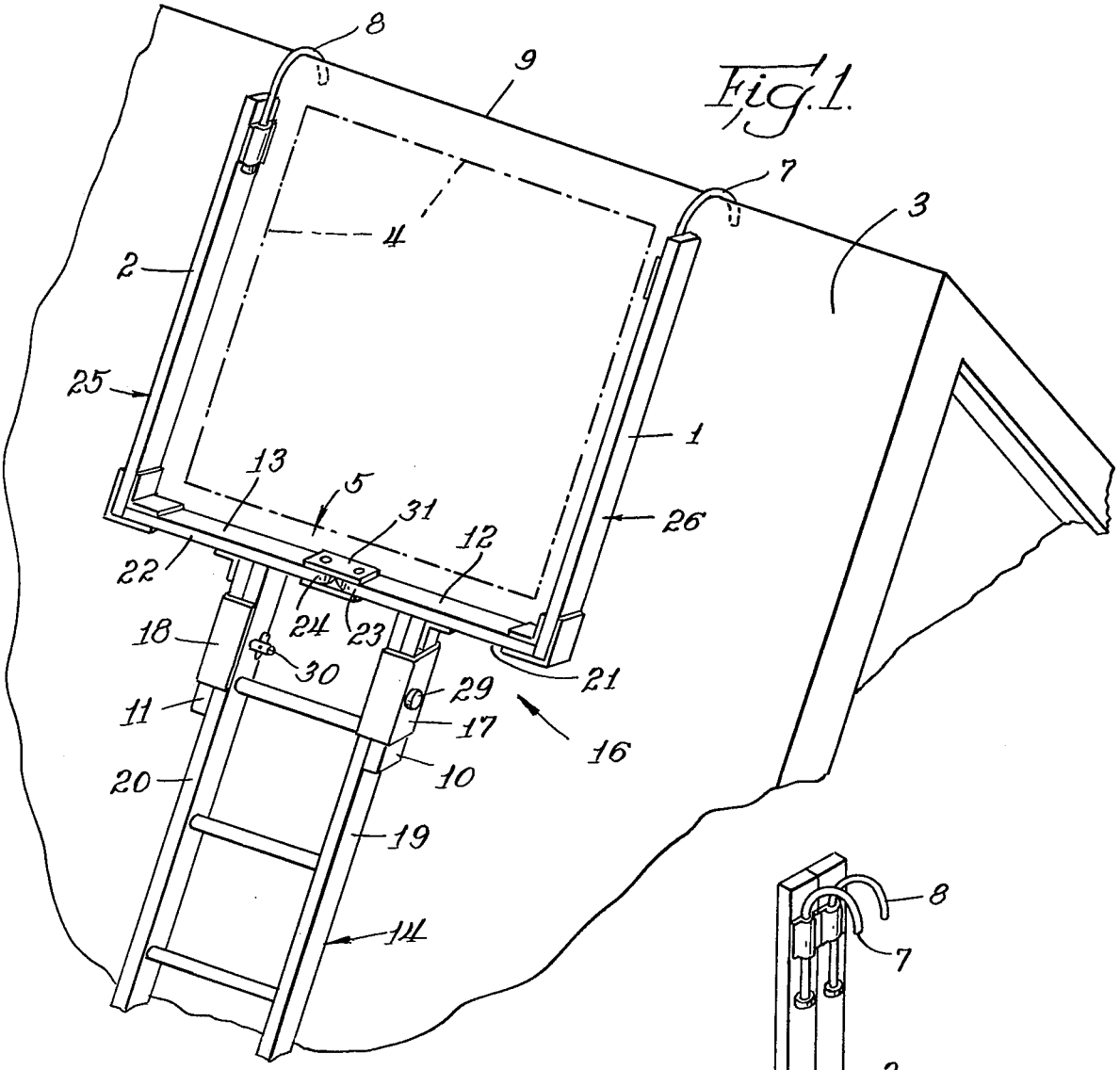
FIG. 1 is a pictorial view of the invention.

In FIG. 1 there is illustrated one embodiment of the present invention. A pair of long side bars, side bar 1 and side bar 2 are separated by a distance greater than the distance across the area of the roof 3 through which the ventilation hole 4 is to be cut. The long side bars 1 and 2, are each integrally secured to a long lower bar member 5. The upper portion of the long side bar 1 is integrally secured to a rigid bar hook 7, and the upper portion of the long side bar 2 is integrally secured to a rigid bar hook 8. The rigid bar hook 7 and the rigid bar hook 8 are hooked over the roof ridge 9 to securely engage the side bars 1 and 2 to the roof ridge 9. A pair of transverse short bars 10 and 11 are integrally secured to the long lower bar member 5.

The two transverse short bars 10 and 11 are integrally secured to the long lower bar member 5 at locations 12 and 13 so that when the roof ladder 14 is attached to the ladder attachment 16, the weight exerted against the long lower bar member 5 is distributed between the two long side bars 1 and 2 in equal proportions. A sleeve portion 17 is integrally secured to the top portion of the ladder bar 19, and the sleeve portion 18 is integrally secured to the top portion of the ladder bar 20. When the transverse short bars 10 and 11 are slid through the sleeve portions 17 and 18, pins 29 and 30 secure the ladder attachment 16 to the roof ladder 14 by sliding through openings in sleeve portions 17 and 18, transverse short bars 10 and 11, and ladder bars 19 and 20.

The long lower bar member 5 consists of a pair of arms 21 and 22. The arms 21 and 22 pivot at the center of the long lower bar member 5 near the end 23 of the arm 21 and the adjacent end 24 of the arm 22. Means to pivot the two arms 21 and 22 is shown as hinge 31. The hinge 31 allows both arms 21 and 22 to swing to a closed position as shown in FIG. 2.

Figure 2:
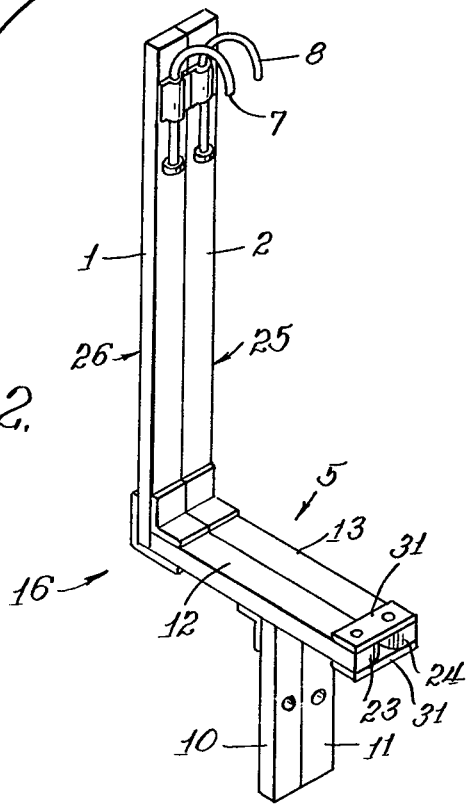
FIG. 2 is a view of the invention folded for storage or for transport.

FIG. 2 shows the two members 25 and 26 of the ladder attachment 16. The left member 25 and the right member 26 of the ladder attachment 16 pivot about the hinge 31 so that the left member 25 fits adjacent to and coincides with the right member 26 for storage or transport purposes.

When the novel invention is in use, the ladder attachment 16 can be carried to the location where it is to be unfolded and attached to the roof ladder 14. The left member 25 and right member 26 are unfolded by pivoting about the hinge 31 and the transverse short bars 10 and 11 side through the sleeves 17 and 18. Pins 19 and 30 secure the ladder attachment 16 to the roof ladder 14. The roof ladder 14 with the ladder attachment 16 secured in place is then hooked over the roof ridge 9.

The preferred structure of the invention has been shown and described in detail. Various changes and modifications that are with in the function of the structure as described and shown are considered to be with in the spirit of the novel invention and may fall with in the scope of the claims.

What I claim as my invention is:

1. A folding ladder attachment device to be attached to the top of a roof ladder to aid in cutting ventilation holes in a roof comprising:

a. a pair of side bars separated by a distance greater than the distance across the area through which the ventilation hole is to be cut;

b. a lower bar member transverse to the pair of side bars and integrally secured to the pair of side bars at the ends of the lower bar member;

c. a pair of transverse bar members spaced apart and attached at one end to a center portion of said lower bar member to allow the top portion of the roof ladder to fit tightly between and parallel to the pair of transverse bar members;

d. a pair of sleeves integrally secured to the top portion of the roof ladder through which the pair of transverse bar members slide;

e. a pair of pins that slide through openings in the sleeve portion, openings in the upper portions of the roof ladder, and openings in the pair of transverse bar members to lock the ladder attachment to the roof ladder;

f. and a pair of rigid bar hooks integrally secured to the upper portions of the pair of side bars to secure the ladder attachment device to the ridge of the roof.

2. The ladder attachment device as claimed in claim 1, wherein the lower bar member includes a pair of arms transverse to the side bars, and hinged means at the ends of the arms near the center of the lower bar member so that the arms pivot about the center of the lower bar member.

3. The ladder attachment device as claimed in claim 1, wherein the pair of rigid bar hooks swing between the side bars for storage.

4. The ladder attachment device as claimed in claim 2, wherein the left member and right member of the ladder attachment device fold together by pivoting around the hinge.

* * * * *